United States Patent [19]

Sanday

[11] 4,169,694

[45] Oct. 2, 1979

[54] CERAMIC ROTOR BLADE HAVING ROOT WITH DOUBLE CURVATURE

[75] Inventor: Santiago C. Sanday, Swarthmore, Pa.

[73] Assignee: Electric Power Research Institute, Inc., Palo Alto, Calif.

[21] Appl. No.: 817,322

[22] Filed: Jul. 20, 1977

[51] Int. Cl.[2] ..... F01D 5/30

[52] U.S. Cl. ..... 416/219 R; 416/241 B

[58] Field of Search ..... 416/219–221, 416/241 B

[56] References Cited

U.S. PATENT DOCUMENTS

| | | | |
|---|---|---|---|
| 2,317,338 | 4/1943 | Rydmark | 416/241 B |
| 2,821,357 | 1/1958 | Schörner | 416/241 B X |
| 3,378,230 | 4/1968 | Toomey | 416/221 |
| 3,784,320 | 1/1974 | Rossmann et al. | 416/219 X |
| 3,910,719 | 10/1975 | Hessler et al. | 416/219 R X |

FOREIGN PATENT DOCUMENTS

| | | | |
|---|---|---|---|
| 1281033 | 11/1961 | France | 416/241 B |
| 753229 | 7/1956 | United Kingdom | 416/241 B |

*Primary Examiner*—Everette A. Powell, Jr.
*Attorney, Agent, or Firm*—Townsend and Townsend

[57] ABSTRACT

A turbine blade having a root provided with a curvature in its transverse and longitudinal cross sections. The root is receivable within the groove in the outer periphery of an attachment piece and the surface portions defining the groove have curvatures slightly greater than those of the root. A compliant pad can be inserted in the groove between each side of the root, respectively, and the corresponding surface portion of the attachment piece. Initially, the root will have a single point of contact with the adjacent surface portion or the compliant pad; but as the blade rotates, this point of contact becomes a line or surface contact to cause loads to be more uniformly distributed between the root and adjacent surface portions.

5 Claims, 4 Drawing Figures

CERAMIC ROTOR BLADE HAVING ROOT WITH DOUBLE CURVATURE

This invention was made under contract with or supported by the Electric Power Research Institute, Inc.

This invention relates to gas turbine engines and, more particularly, to improvements in the blades of the rotor of such an engine.

BACKGROUND OF THE INVENTION

It is a well-established fact that the most important gas turbine engine parameter that can benefit fuel and capital conservation goals is the turbine inlet temperature. In the present state of the art, this temperature is limited because both the blades and the rotor disk of a turbine rotor are metallic and cannot withstand the gas temperatures above certain maximum values.

Ceramic materials are currently under investigation for use in making turbine blades. The major roll of ceramics is their potential capability to operate at inlet temperatures and in corrosive environments that far exceed the capability of any uncooled alloy system. The use of cooling schemes needed for metals, in one way or the other, must use part of the available energy to remove heat from high temperature locations. This results directly in efficiency penalties. The ultimate goal is to make the best use of ceramics in an efficient combined cycle (gas turbine/steam turbine plant) that uses coal derived fuels. To use ceramics in turbine blade designs, a specific rotor configuration is one having a low alloy steel disk, an intermediate superalloy attachment piece, and a ceramic blade. This approach allows the best use of ceramics as well as the design flexibility needed for rugged industrial gas turbines.

The root attachment section of a gas turbine first stage rotating ceramic blade has been identified as the critical area for the development of stress problems. Centrifugal forces and thermal conditions combine to generate high loads which must be transferred at the surface of contact between the root of the blade and the surface defining the groove of the intermediate piece which attaches the blade to the disk.

The rigidity and lack of ductility of the ceramic root of a ceramic blade combine to create high direct local compressive stresses and high secondary tensile stresses. These arise from the misfit between the bearing surface of the root and the bearing surface defining the groove. The tensile stresses are augmented by friction between the two bearing surfaces that results when loads are applied, i.e., centrifugal force field and differential thermal expansion of the components. Because of these problems, a need has arisen for an improved ceramic turbine blade which is designed and constructed to transfer the load substantially uniformly between the blade root and the disk of the turbine so as to permit the turbine to be operated at high inlet gas temperatures.

SUMMARY OF THE INVENTION

The present invention satisfies the foregoing need by providing a turbine blade of improved construction wherein the blade has a dovetail, double curvature root for improving the local distribution of load transfer from the root to the attachment piece coupling the blade rotor to the disk of a turbine. This feature operates to minimize the stresses and thermal expansion in the vicinity of the root which would otherwise cause structural damage.

To this end, the curvature of the root of the blade is made so that, in both the longitudinal and transverse directions, the root engages the surface defining the groove or engages a compliant pad in the groove only at one point, since the curvature of the root is slightly less than that of the surface defining the groove. As the rotational speed increases, the centrifugal force exerted on the root increases, causing the initial point contact to become a growing surface. Thus, by properly choosing the initial point of contact on the root in the lower part of its transverse cross section, the maximum stresses in the root are minimized. Moreover, by properly choosing the inital point of contact in the center of the root in its longitudinal cross section, the maximum stresses are forced to occur in a triaxial state rather than in a biaxial state at the ends of the root.

The primary object of this invention is to provide an improved turbine blade having a root for insertion into a groove of an attachment piece for coupling the blade to a turbine disk, wherein the root and the groove are configured to provide an improved distribution of load transfer to minimize the stresses and thermal expansion in the root and thereby minimize structural damage to the root and provide a long operate life for the blade.

Another object of this invention is to provide a blade and an attachment piece of the type described, wherein the root of the blade has a curvature both in the longitudinal and transverse directions with the root curvature in both directions being less than that of the surface portions of the attachment piece defining the groove thereof so that contact between the root and the surface or a compliant pad in the groove will initially be at a point but such contact will become a growing surface as the blade and attachment piece rotate to thereby assure an improved distribution of load substantially uniformly between the root and the surface.

Other objects of this invention will become apparent as the following specification progresses, reference being had to the accompanying drawing for an illustration of the invention.

IN THE DRAWING

Figure 1:
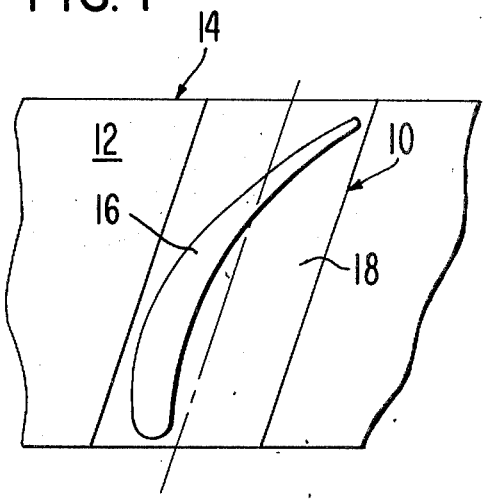
FIG. 1 is a top plan view of a turbine blade using the teachings of this invention.
Figure 2:
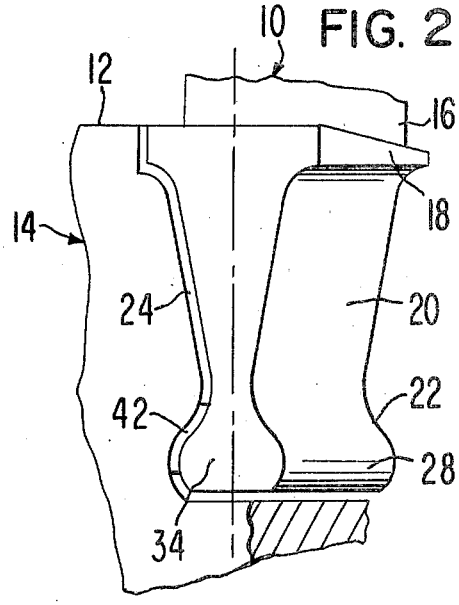
FIG. 2 is an enlarged, side elevational view of a portion of the turbine blade showing the root thereof.

The turbine blade of this invention is broadly denoted by the numeral 10 and is adapted for use on the outer periphery 12 of an attachment piece 14, the latter adapted to be coupled to a turbine disk (not shown), whereby blade 10, along with a plurality of other identical blades, is caused to rotate in a predetermined direction under the influence of gases flowing past the blade, such as in the direction of arrow 26 (FIG. 1). For use in a gas turbine, blade 10 is formed of a ceramic material. For use in a steam turbine, the blade will be made of a metal alloy.

Blade 10 has a blade section 16 which has a specific airfoil configuration as shown in FIG. 1. Blade section 16 is integral with a base 18, the latter being integral with a neck 20 having a root 22 at the lower end thereof. Neck 20 and root 22 are received within a respective outer peripheral groove 24 in attachment piece 14. If the gases for driving blade 10 and thereby the turbine disk are assumed to move in the direction of arrow 26, root 22 extends longitudinally of the direction of the gases. It is to be understood, however, that the teachings of the present invention can be applied to the case where the root extends substantially perpendicular to the direction of flow of the gases. The latter case, however, is not illustrated since a description of the longitudinally extending root of FIGS. 1–4 should suffice to illustrate the teachings of the invention.

Figure 3:
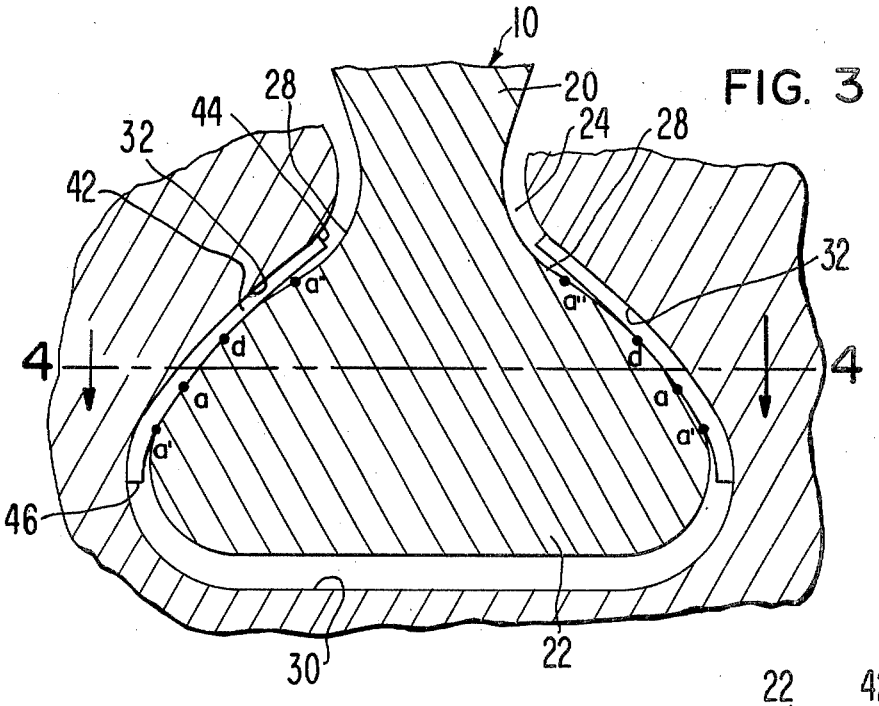
FIG. 3 is an enlarged, fragmentary, cross-sectional view of the root, showing the way it is disposed within the groove of an attachment piece.

Root 22 has a double curvature in the sense that it is curved or convex at its side faces 28 as shown in the transverse cross section of FIG. 3. Each face 28 has a radius of curvature less than the corresponding radius of curvature of surface portion 32 defining the groove part adjacent to each face 28, respectively.

Figure 4:
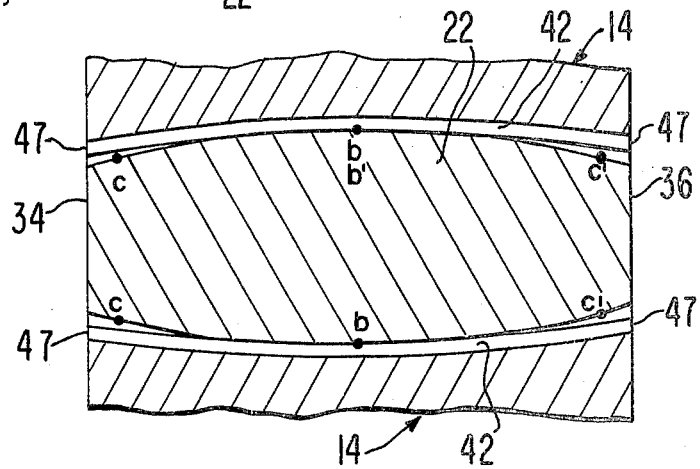
FIG. 4 is a cross-sectional view taken along line 4—4 of FIG. 3.

A second, longitudinal curvature of root 22 is shown in FIG. 4 wherein the curvature extends longitudinally along both side faces 28 between the front flat face 34 of root 22 and the rear flat face 36 thereof as shown in FIG. 4. This longitudinal curvature of the root is less than the corresponding longitudinal curvature of surface portion 32. Thus, each face 28 and the corresponding surface portion 32 have transverse and longitudinal curvatures.

A compliant pad 42 can be used in groove 24 between each side face 28, respectively, and the adjacent groove-defining surface portion 32. Pad 42 has an upper longitudinal edge 44 near the bottom end of neck 20 and a lower longitudinal edge 46 spaced above bottom 30 of groove 24, edge 46 being at a location where the corresponding face 28 of the root commences to extend downwardly and inwardly toward bottom 30. The end edges 47 of each pad 42 terminate adjacent to front and rear faces 34 and 36 of root 22. The thickness of each pad is substantially uniform as shown in FIG. 4.

The dimensions of the root and groove are such that, in the transverse direction of the root (FIG. 3), there is an initial or no-load point of contact at point "a" near the outer edge of the final surface of contact. As the centrifugal force in the radial direction increases due to rotation of the blade, root 22 and compliant pad 42 deform along with surface portion 32 and the point of contact of the root becomes essentially a line a'a" with the nearest distance between the surfaces 28 and 32 occurring between points a' and a", for example, at point "d".

In the longitudinal direction of the root (FIG. 4), the initial point of contact is the geometric midpoint "b", which, by design, is made to coincide with the midpoint of the centrifugal force loading. As the load increases, the root, groove and compliant pad deform and the point of contact becomes a line contact along line cc' with the nearest distance between the root and the groove surface remaining at point "b". The development of the contact surface may be visualized in a simple manner by thinking about an initial point contact that grows simultaneously in the transverse and longitudinal directions such that a roughly elliptical shape develops which, when fully developed, ends in a rectangular surface contact at each side of the root.

While the load transferred by these surfaces is not completely uniform, the maximum load is transferred at the point where two surfaces are the closest, point bd where the compliant pad has compressed the most. The minimum load is transferred at either end of the root length near a particular end face 34 or 36. This places the maximum load transfer at a location which is in a state of plane strain and the minimum at locations in a state of plane stress. This is consistent with the failure of strength that may be expected at each location.

The magnitude of the stresses induced by the centrifugal load and the differential thermal expansion varies as a function of the frictional coefficient between the contact surfaces. To minimize these stresses, compliant pad 42 should serve as a lubricating layer.

The compliant pad need not be used. If it is not used, the initial and final points of contact remain the same as those described above with respect to the case where the compliant pad is used.

While the present invention is especially suitable for use with ceramic turbine blades adapted for gas turbines, it is also suitable for use with turbine blades adapted for steam turbines.

I claim:

1. In a turbine: an attachment piece having an elongated groove in its outer periphery; and a pair of spaced surface portions defining at least parts of the sides of the groove, each surface portion having concave shapes in the transverse and longitudinal directions, respectively, with reference to the longitudinal axis of the groove; and a turbine blade for attachment to the attachment piece, the turbine blade having a blade section, a base coupled to the radially innermost end of the blade section, and a root coupled with the base, the root being insertable into the groove of the attachment piece, the root having a pair of side faces, each of the side faces having convex shapes in the transverse and longitudinal directions, respectively, with reference to the longitudinal axis of the groove, the curvatures of the convex shapes of the root being greater than the corresponding curvatures of the concave shapes of the adjacent surface portions of the groove, there being an initial point contact between each side face of the root and the adjacent surface portion of the groove.

2. In a turbine as set forth in claim 1, wherein the point of contact is at a midpoint between the end faces of the root.

3. In a turbine: an attachment piece having an elongated groove in its outer pheriphery; and a pair of spaced surface portions defining at least parts of the sides of the groove, each surface portion having concave shapes in the transverse and longitudinal directions, respectively, with reference to the longitudinal axis of the groove; and a turbine blade for attachment to the attachment piece, the turbine blade having a blade section, a base coupled to the radially innermost end of the blade section, and a root coupled with the base, the root being insertable into the groove of the attachment piece, the root having a pair of side faces, each of the side faces having convex shapes in the transverse and longitudinal directions, respectively, with reference to the longitudinal axis of the groove, the curvatures of the convex shapes of the root being greater than the corresponding curvatures of the concave shapes of the adjacent portions of the groove; a compliant pad in the groove between each side face, respectively, of the root and the adjacent surface portion of the groove, there being an initial point contact between each side face of the root and the adjacent compliant pad.

4. In a turbine as set forth in claim 3, wherein the point of contact is at a midpoint between the end faces of the root.

5. In a turbine as set forth in claim 3, wherein each compliant pad extends along at least major parts of the convex shapes of the respective side face of the root.

* * * * *